United States Patent [19]

Robbins

[11] Patent Number: 4,631,440

[45] Date of Patent: Dec. 23, 1986

[54] COLOR CATHODE RAY TUBE HAVING SMOOTH SCREEN EDGES

[75] Inventor: John D. Robbins, Seneca Falls, N.Y.

[73] Assignee: North American Philips Consumer Electronics Corp., New York, N.Y.

[21] Appl. No.: 728,368

[22] Filed: Apr. 29, 1985

[51] Int. Cl.[4] ..... H01J 29/07; H01J 31/20

[52] U.S. Cl. ..... 313/403

[58] Field of Search ..... 313/403, 408

[56] References Cited

U.S. PATENT DOCUMENTS

| | | | |
|---|---|---|---|
| 3,766,419 | 10/1973 | Barbin | 313/403 |
| 3,856,525 | 12/1974 | Inoue | 313/403 X |
| 3,973,159 | 8/1976 | Barten | 313/403 |
| 4,300,070 | 11/1981 | Godfrey et al. | 313/403 |

FOREIGN PATENT DOCUMENTS

| | | | |
|---|---|---|---|
| 2841286 | 4/1980 | Fed. Rep. of Germany | 313/403 |
| 24073 | 2/1977 | Japan | 313/403 |
| 3464 | 1/1979 | Japan | 313/403 |
| 128549 | 10/1981 | Japan | 313/403 |

*Primary Examiner*—Stewart J. Levy
*Assistant Examiner*—Joseph W. Roskos
*Attorney, Agent, or Firm*—John C. Fox

[57] ABSTRACT

In a color cathode ray tube having a vertically striped screen and a vertically slotted aperture mask, the top and bottom screen edges are made smooth by varying the vertical pitch between mask apertures while keeping the number of apertures per vertical column constant, so that every other column terminates in a full length slot.

7 Claims, 3 Drawing Figures

COLOR CATHODE RAY TUBE HAVING SMOOTH SCREEN EDGES

BACKGROUND OF THE INVENTION

This invention relates to color cathode ray tubes (CRTs) having vertically striped phosphor screens and slotted aperture masks, and more particularly relates to such CRTs having smooth top and bottom screen edges.

Color CRTs for color television produce an image display on a cathodoluminescent screen composed of a repetitive array of red, blue and green phosphor elements, by scanning the array with three electron beams from an electron gun in the neck of the CRT, one beam for each of the primary (red, blue and green) colors. The beams emanate from separate gun apertures, converge as they approach the screen, pass through an aperture mask positioned a short distance (designated "Q") behind the screen, and then diverge slightly to land on the appropriate phosphor element. At a comfortable viewing distance, the human eye cannot resolve the individual red, blue and green elements in the screen, but rather integrates these primary colors to perceive additive colors produced by the primary colors.

Early CRTs for color television had screens composed of arrays of phosphor dots, but dot screens have been largely replaced by screens composed of arrays of vertically oriented phosphor stripes. As is known, such screens are primarily advantageous in alleviating the requirement for accurate registration between the mask and screen in the vertical direction.

The masks for these striped screens are composed of vertically oriented columns of slot-shaped apertures separated from one another by so-called "tie bars" of mask material, which "tie" the mask together to provide needed mechanical strength. The slots in adjacent columns are usually staggered in some manner in order to avoid moire, an annoying beat pattern on the screen caused by slight, unintentional misregistration between the mask, screen and raster scan patterns.

Unfortunately, this staggering of the slots, together with the convex curvature conventionally designed into the top and bottom edges of the mask array, results in aperture columns ending randomly in partial slots of varying length or in tie bar zones, and leaves the appearance of a ragged screen edge.

In U.S. Pat. No. 4,300,070, this problem is addressed by changing the length of the end portions of the aperture columns in a border region of the mask. Specifically, in all columns in which terminal slots would be less than one-half the length of a full slot, the last full slot is lengthened to end at the edge of the border. However, this approach tends to require rather complex mask designs, and also tends to result in changes in the brightness of the screen display image in this border region.

Accordingly, it is an object of this invention to provide in a color CRT with a striped screen and a slotted aperture mask, an aperture mask which enables smooth top and bottom screen edges.

It is a further object of the invention to provide such a mask which is relatively simple in design and does not require non-uniform changes in the border regions of the mask array.

SUMMARY OF THE INVENTION

In accordance with the invention, in a color CRT having a vertically striped phosphor screen and an aperture mask having an array of slot shaped apertures arranged in vertical columns corresponding to the vertical phosphor stripes, the distance from the center of one slot to the center of a vertically adjacent slot being designated as vertical pitch, the slots in adjacent columns being vertically displaced from one another, slots in non-adjacent columns lying in horizontal rows, and diagonally adjacent slots lying in adjacent rows, the array being defined by top, bottom, left and right edges, and at least the top and bottom edges being curved, these top and bottom edges are made relatively smooth by providing for every other column to terminate in full length slots, and adjacent columns to terminate in partial length slots, and the vertical pitch to vary uniformly in a manner to maintain the same number of slots in every other column.

In accordance with a preferred embodiment, the columns which terminate in partial length slots extend beyond the adjacent columns by an amount less than one-half of a full length slot. This embodiment may be advantageous in that the mask is often used as a photomask in the photolithographic production of the CRT screen, and in that larger partial apertures are sometimes required to produce phosphor stripes ending at the defined screen edge.

DESCRIPTION OF THE PREFERRED EMBODIMENTS

Figure 1:
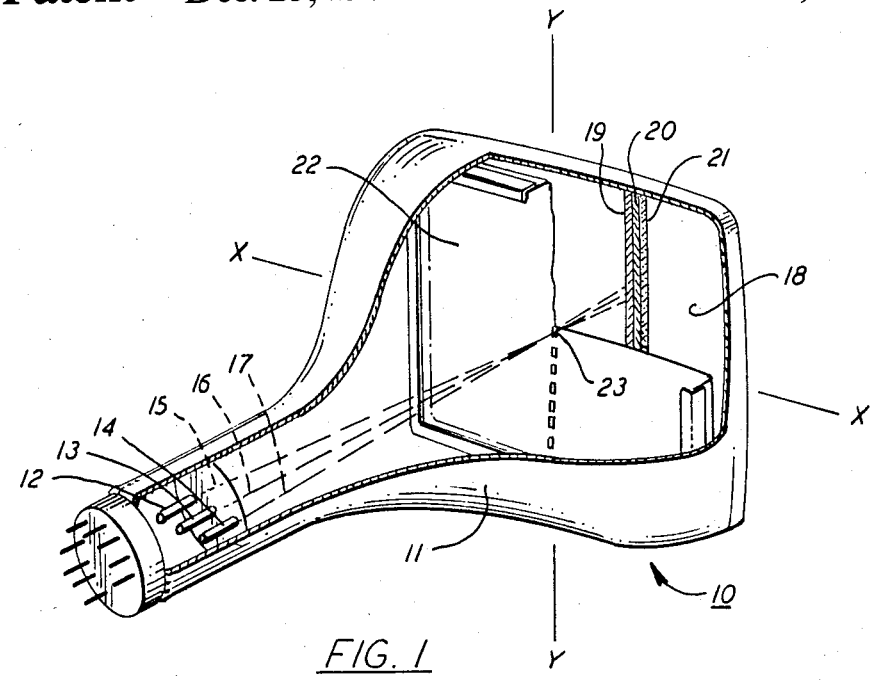
FIG. 1 is a perspective view, partly cut away, of a color CRT employing a smooth screen edge of the invention.

Referring now to FIG. 1, color CRT 10 is composed of evacuated glass envelope 11, electron guns 12, 13 and 14, which direct electron beams 15, 16 and 17 toward screen 18, composed of alternating red, blue and green phosphor stripes, three of which, 19, 20 and 21 are shown. The beams 15, 16 and 17 converge as they approach aperture mask 22, then pass through vertical aperture column 23 and diverge slightly to land on the appropriate phosphor stripe 19, 20 or 21. Additional columns of apertures similarly correspond to additional stripe triplets, not shown. External deflection coils and associated circuitry, not shown, cause the beams to scan the mask and screen in a known manner, to produce a rectangular raster pattern on the screen.

Figure 2:
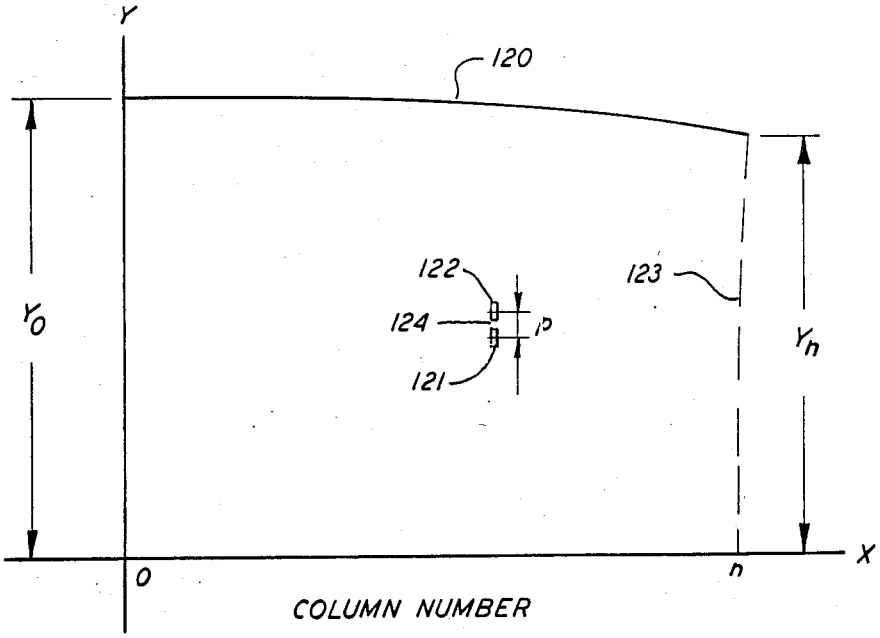
FIG. 2 is a graph of slot column height on the vertical (Y) axis and column number on the horizontal (X) axis for an upper quadrant of the aperture mask for the CRT of FIG. 1.

Mask 22 and screen 23 are divided into quadrants by horizontal (X) and vertical (Y) axes, sometimes referred to as the major and minor axes. Because the quadrants are symmetrical with respect to these axes, it is conventional practice to specify a mask design by referring to only one of these quadrants. Accordingly, FIG. 2 shows the upper right hand (as viewed from the rear view of FIG. 1) quadrant of mask 22, in which top edge 120 of the aperture array has a slight convex curvature, indicating symmetrical curvatures in the remaining quadrants. The number of aperture columns is indicated on the X axis as O to n, and the height of these columns is indicated as Y(O) to Y(n). The distance between the center of an aperture 121 to the center of a vertically adjacent aperture 122 is designated as vertical pitch "p". The mask material separating these apertures is referred to as tie bar 124. (Right hand edge 123, defined by column "n", generally has a slight concavity in order to result in a substantially straight screen edge.)

In conventional mask designs, the vertical pitch between apertures is generally held constant across the entire mask (except for slight variations caused by forming the flat mask into the desired contour). As will be appreciated, the curvature of the top and bottom edges of the aperture array causes these edges to intersect the apertures and tie bars in a more or less random manner, resulting in a ragged appearance to the screen edge. This ragged appearance is aggravated by the further practice of staggering apertures in adjacent columns to avoid moire on the screen. Such staggering is generally achieved simply by vertically displacing the slots in every other column by the distance of one half "p".

In accordance with the invention, this ragged appearance is substantially avoided by causing the vertical pitch "p" to vary from column to column so that the columns all have the same number of slots and the unstaggered columns all terminate in full length slots. This can be achieved, for example, by choosing a suitable number (integer m) of vertical pitches for the entire mask array and calculating the vertical pitch for each column by dividing the appropriate column height in the quadrant by m/2, the number of vertical pitches in the quadrant. In a mask design having an odd integer m and having odd numbered columns staggered from even numbered columns by one-half "p", the first column (designated "O") has its first slot in the quadrant centered at the origin (intersection of the X and Y axes) and its last slot is a full length slot terminating at edge 120. The second column (designated 1) has its first slot in the quadrant centered a distance of one-half "p" above the X axis and a smaller vertical pitch so that its last slot terminates at edge 120 as a partial length slot of length given by the following expression:

$\frac{1}{2}$ (p minus length of a full tie bar)

Since one-half "p" is equal to one-half a slot length plus one-half a tie bar length, the partial slot length is less than half a slot length by half a tie bar length.

The vertical pitch is then decreased for each succeeding column numbered "2" through "n", so that all even numbered columns terminate in full length slots and all odd numbered columns terminate in partial length slots.

For example, where there are 531 slots on the full length minor axis and where the quadrant height at the Y axis (including one-half a tie bar) is 189.69 millimeters, and the desired number of vertical pitches is 265.5 (531÷2), the vertical pitch for column "O" is 0.7145 millimeters. Similarly, the quadrant height for column number 250 is 188.82 millimeters, and the vertical pitch is 0.7112 millimeters.

In a typical "full square" design in which the screen is more nearly rectangular than in prior designs, the top and bottom edges of the mask array have a radius of curvature of from about 3,000 to 20,000 millimeters, versus 1,000 to 5,000 millimeters for prior designs. Such full square designs typically have from about 190 to 350 vertical pitches per quadrant column, and the vertical pitch varies from about 115 to 135 percent of the slot length at the Y axis to about 110 to 130 percent of the slot length at the left and right edges of the arrary.

The same basic method can be used whether the number of pitches in a full column is odd or even, and whether a slot or a tie bar is located at the origin, and whether the odd or even numbered columns end in a full or partial length slot.

In the photolithographic process used conventionally to produce the phosphor screen, the aperture mask is used as a photomask. In practice, it has been found that partial length slots at column ends sometimes result in less than optimum dosages (intensity times time) of actinic radiation to the photoresist, and consequently, shorter than desired phosphor stripes on the screen. Accordingly, in a preferred embodiment of the invention, the partial slots are extended slightly beyond the edge of the aperture array in order to result in smoother screen edges produced photolithographically.

Figure 3:
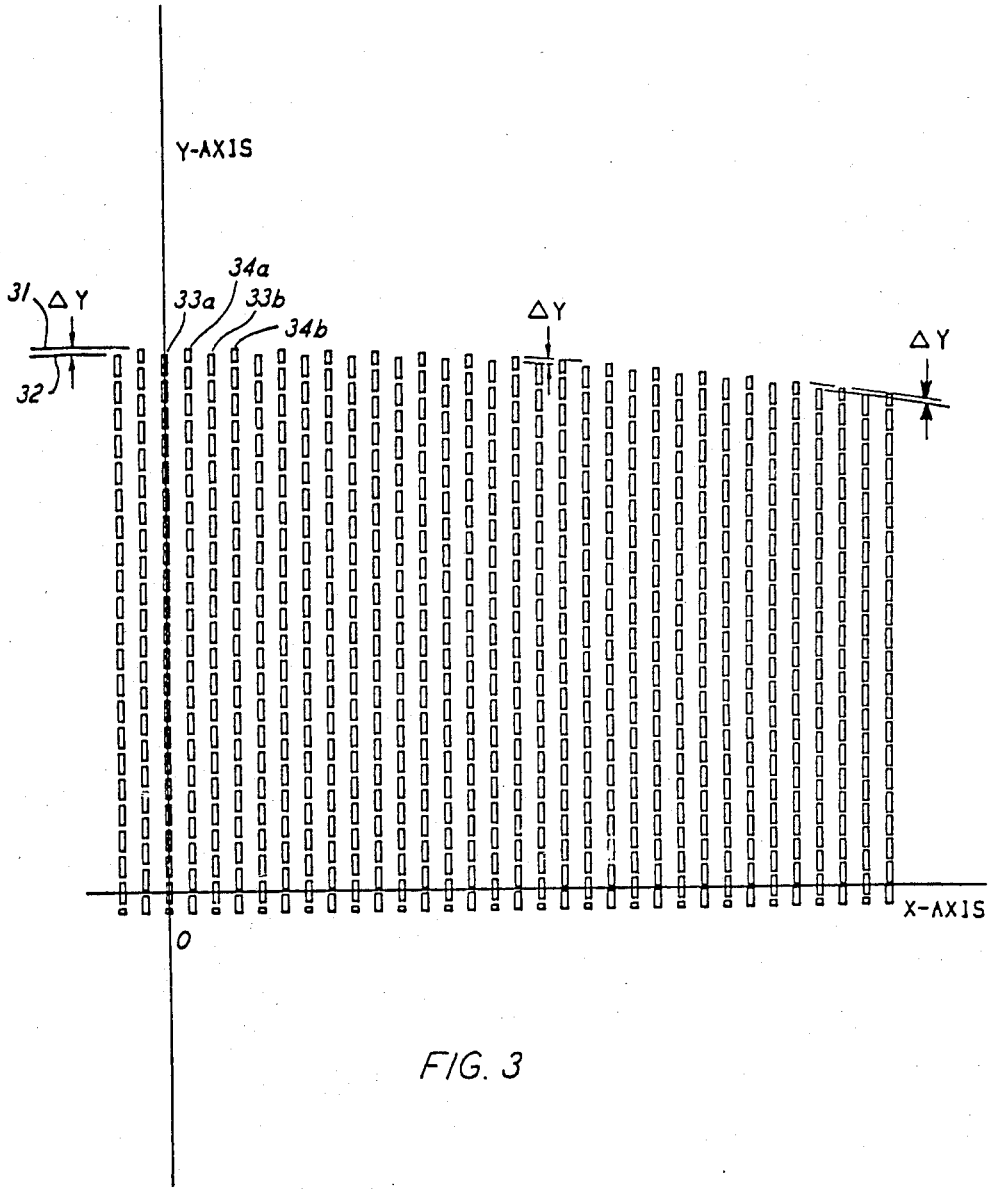
FIG. 3 is a graph similar to that of FIG. 2 showing a preferred embodiment of the invention in which columns ending in partial length slots extend beyond adjacent columns ending in full length slots.

Such a preferred mask array is shown in FIG. 3. FIG. 3 is a computer plot (exaggerated) of an array in which the slot length and the number of pitches is kept constant, and in which partial slots 34 in odd numbered columns extend beyond the full length slots 33 in even numbered columns by a constant amount $\Delta Y$ across the edge of the array 32 to form a secondary edge 31.

The preferred embodiment is particularly advantageous when the partial slots would otherwise be very short (100–150% of slot width). In addition, very short slots tend to be difficult to produce by the conventional photoetching process used to form the masks.

By way of example, it has been found that smooth screen edges may be obtained by the conventional black matrix photolithographic process using the aperture mask as a photomask, where the terminal partial length slots are from about 50 to 80 percent of the length of the full length slots.

What is claimed is:

1. In a color CRT having a cathodoluminescent screen comprising an array of vertical phosphor stripes and an aperture mask positioned in spaced relationship to the screen, the mask comprising an array of slot-shaped apertures arranged in vertical columns corresponding to the vertical phosphor stripes, the distance from the center of one slot to the center of a vertically adjacent slot being designated as vertical pitch, the slots in adjacent columns being vertically displaced from one another, slots in non-adjacent columns lying in horizontal rows, and diagonally adjacent slots lying in adjacent rows, the array defined by top, bottom, left and right edges, at least the top and bottom edges being curved, characterized in that every other column terminates in full length slots, and adjacent columns terminate in partial-length slots, and the vertical pitch varies uniformly between each row of adjacent slots to maintain the same number of slots in every other column, thereby to provide relatively smooth edges.

2. The CRT of claim 1 in which the columns terminating in partial length slots extend beyond the adjacent columns by an amount less than one-half of a full slot length.

3. The CRT of claim 2 in which the partial length slots have lengths of from about 50 to 80 percent of the full length slots.

4. The CRT of claim 1 in which the array is bisected horizontally by an X axis and vertically by a Y axis, and in which the top and bottom edges of the mask array curve convexly and symmetrically with respect to the X axis.

5. The CRT of claim 4 in which the top and bottom edges of the mask array have a radius of curvature of from about 3,000 to 20,000 millimeters.

6. The CRT of claim 5 in which the length of the full length slots is constant.

7. The CRT of claim 6 in which there are from about 190 to 350 vertical pitches per quadrant column, and the vertical pitch varies from about 115 to 135 percent of the slot length at the Y axis to about 110 to 130 percent of the slot length at the left and right edges of the array.

* * * * *